242-129.6 SR
10/22/85 OR 4,548,368

United States Patent [19]

Tomlinson

[11] Patent Number: 4,548,368

[45] Date of Patent: Oct. 22, 1985

[54] WIRE CADDY

[76] Inventor: Thomas L. Tomlinson, 5210 Bluff Rd., Indianapolis, Ind. 46217

[21] Appl. No.: 526,476

[22] Filed: Aug. 25, 1983

[51] Int. Cl.[4] ..... B65H 59/16

[52] U.S. Cl. ..... 242/129.6; 242/156

[58] Field of Search ..... 242/129.62, 129.72, 242/129.53, 129.6, 129.7, 125, 107.15, 156.1, 156, 129.8; 211/26

[56] References Cited

U.S. PATENT DOCUMENTS

| | | | |
|---|---|---|---|
| 215,609 | 5/1879 | Hanford . | |
| 447,153 | 2/1891 | Holmes | 242/156.1 |
| 545,549 | 9/1895 | Strodel | 242/129.62 |
| 1,022,077 | 4/1912 | Haas | 242/129.62 |
| 1,664,467 | 4/1928 | Roeske | 242/156.1 |
| 2,488,492 | 11/1949 | Dumbleton | 242/156 |
| 2,601,960 | 7/1952 | Hick | 242/129.6 |
| 3,028,117 | 11/1960 | Shepley . | |
| 3,069,107 | 12/1962 | Hirt | 242/156 |
| 3,190,574 | 6/1965 | Purzycki | 242/156 |
| 3,304,025 | 8/1965 | Zerg et al. . | |
| 3,346,214 | 10/1967 | Berkeley | 242/156.1 |
| 3,603,526 | 9/1971 | Payne | 242/156 X |
| 3,937,417 | 2/1976 | Guenther . | |
| 4,143,832 | 3/1979 | Platt . | |

FOREIGN PATENT DOCUMENTS

| | | | |
|---|---|---|---|
| 988890 | 11/1976 | Canada | 242/129.6 |

*Primary Examiner*—Stephen Marcus
*Assistant Examiner*—Leo J. Peters
*Attorney, Agent, or Firm*—Woodard, Weikart, Emhardt & Naughton

[57] ABSTRACT

A wire caddy for carrying a plurality of wire spools. The wire caddy comprises a base, a spool mounting rod journably mounted in the base and removable therefrom, and a handle pivotally attached to the base. The handle integrally includes at its base an elongate member for braking the unwinding of the wire spools. The handle pivots between a first position in which the elongate member frictionally engages the wire spools, and a second position, radially spaced from the first position, in which the handle serves as a means for carrying the caddy. The elongate member permits the wire spools to be selectively unwound without also unwinding any other of the wire spools. The handle further includes a plurality of guide slots for guiding the unwinding of wire from the wire spools.

5 Claims, 2 Drawing Figures

WIRE CADDY

BACKGROUND OF THE INVENTION

The present invention relates generally to the field of portable devices for carrying wire wound on spools and, more particularly, to those devices which provide increased control over the unwinding of the wire.

In the course of servicing various electrical equipment, it is common for electrical maintenance or service personnel to be equipped with several sizes of electrical wire. Wire for such purposes is provided by the manufacturer on spools having standardized diameters. Thus, 500' lengths of 10-12-14-16-18 gauge electrical wire may be provided by a particular manufacturer on spools having the same diameter, such as for example, 7 inches.

When servicing electrical equipment, it is for obvious reasons desirable to have at hand several spools carrying different gauges of wire. However, carrying the spools in a tool box or other similar device is cumbersome and inconvenient in that the spools are not readily available for use. Further, if the free ends of the wires in the spools are not secured to the spools, the wires are free to unwind from the spools. If the wire ends are secured to the spools, they must be manually disattached therefrom prior to unwinding the spools.

A further inconvenience results from having to unwind the wire manually from the spool. Even if the wire spools are mounted on a spindle device to facilitate unwinding, without some type of braking device, an excessive pull causes the spools to unwind too far. And, if a separate spindle device is used for each spool, carrying the spools is rendered even more cumbersome.

SUMMARY OF THE INVENTION

A wire caddy for carrying one or more wire spools, according to one embodiment of the present invention comprises a base, a rod mounted to the base and rotatably receiving thereon the one or more wire spools, and a handle pivotally attached to the base. The handle integrally includes means for braking the unwinding of the wire spools. The handle pivots between a first position in which the braking means frictionally engages the one or more wire spools, and a second position, radially spaced from the first position, in which the handle serves as a means for carrying the caddy.

It is an object of the present invention to provide an improved wire caddy for carrying one or more wire spools.

Related objects and advantages of the present invention will become more apparent by reference to the following figures and detailed description.

DESCRIPTION OF THE PREFERRED EMBODIMENT

Figure 1:
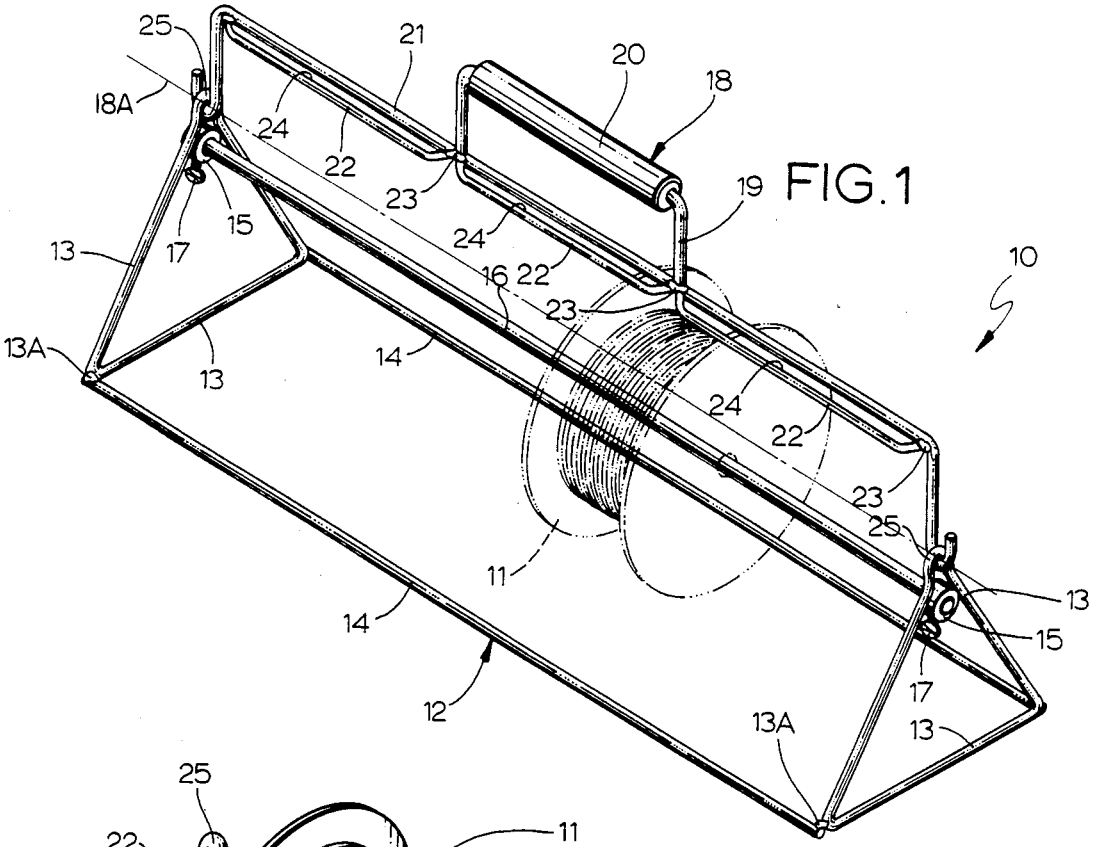
FIG. 1 is a perspective view of the preferred embodiment of the wire caddy of the present invention with the handle in a raised position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, there is shown wire caddy 10 constructed in accordance with the present invention and carrying a number of wire spools 11 rotatably mounted therein. The wire spools may, for example, be 7" diameter spools respectively carrying 500' lengths of 10,12,14,16 and 18 gauge wire. Caddy 10 comprises a generally prism shaped metal support base 12 having triangular shaped end frames 13 connected at weldments 13A to two horizontally disposed side bars 14. Two annular members 15 are fixedly mounted by suitable means, such as welding, within the respective end frames 13 and journably receive therein a loading spindle 16 having a diameter slightly smaller than the inner diameter of spools 11. Hitch pins 17 engage spindle 16 through apertures in members 15 and serve to hold spindle 16 rigidly in place and permit easy removal of spindle 16 in order to load thereon wire spools 11. A handle 18 is pivotally attached to base 12 at the respective apices 25 of end frames 13. Handle 18 pivots on axis 18A which is located vertically above the center axis of spindle 16. Handle 18 includes a handle portion 19 having a wooden grip 20, and an elongate rod 21 integrally connected to handle portion 19 at the base thereof by suitable means, such as weldments. Three guide bars 22 extend along the length of rod 21 and are integrally secured thereto at weldments 23. Guide bars 22 along with rod 21 define horizontal guide slots 24 through which are received wire from spools 11. The width of guide slots 24 may be slightly larger than the diameter of the highest gauge wire to be received therethrough.

Figure 2:
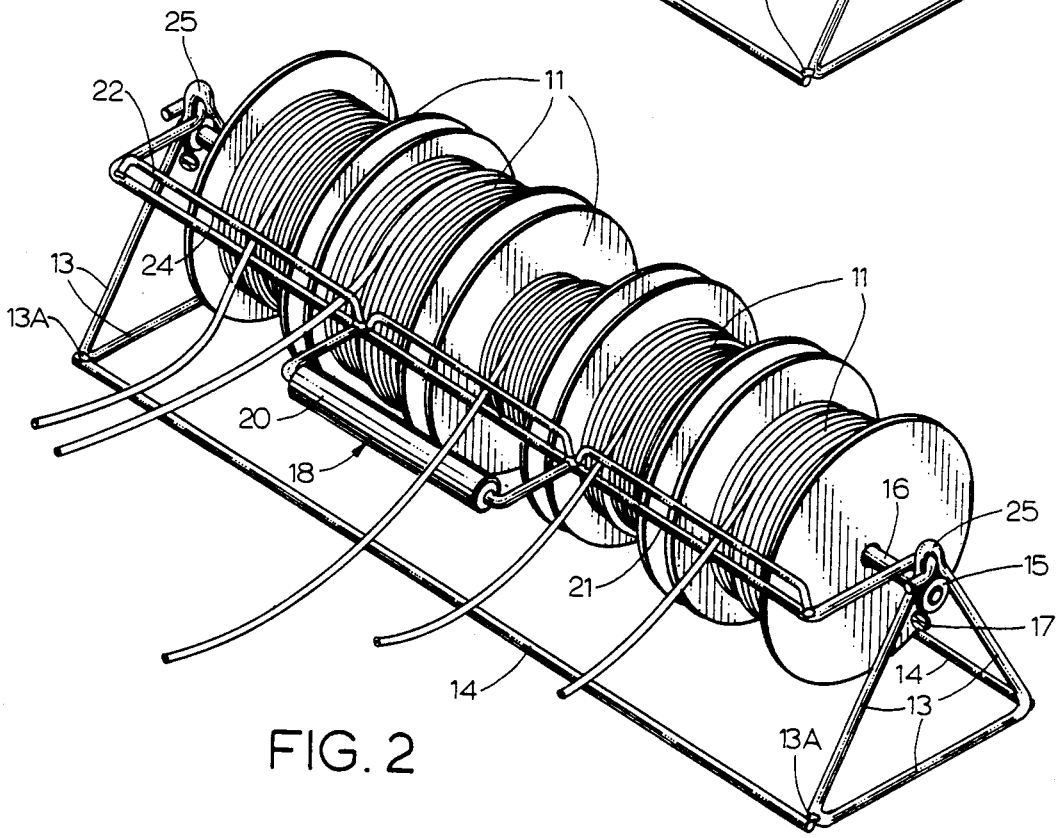
FIG. 2 is a perspective view of the wire caddy of FIG. 1 having a number of wire spools mounted therein and showing the handle in a lowered position resting on the wire spools.

Having described the construction of wire caddy 10 in detail, reference will now be made to the details of its operation. As depicted in FIGS. 1 and 2, handle 18 pivots between vertically raised and lowered positions. In the vertically raised position shown in FIG. 1, handle 18 serves as a convenient means of carrying wire caddy 10. In the lowered position depicted in FIG. 2, rod 21 rests upon the respective annular surfaces of spools 11 with the wires from spools 11 extending through guide slots 24. Rod 21 thus provides frictional engagement with spools 11 in order to serve as a means of braking and controlling the unwinding of the spools 11. Referring to FIG. 2, it is noted that when wire from spools 11 is unwound by pulling from an upwards direction, the wire will frictionally engage one of the guide bars 22, thus braking unwinding of the wire. Thereafter, when pulling is ceased, rod 21 frictionally engages the spools 11 to brake spool rotation. An additional useful purpose served by engagement of rod 21 against spools 11 is that spools 11 will not tend to move laterally along rod 21 and lose their spaced apart relationship as one or more of spools 11 are unwound. Thus, one or more of spools of wire may be selectively unwound at the same time without unwinding wire in any of the other spools. As wire is unwound from the spools, it passes through one of the guide slots 24 which facilitates keeping the wires free from knotting, kinking, or criss-crossing to any great extent.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wire caddy for carrying one or more wire spools, comprising:

a base;

a rod mounted to said base, said rod rotatably receiving thereon said one or more wire spools;

a handle pivotally attached to said base; and a means for braking the unwinding of said one or more wire spools, said braking means attached to said handle and pivotable therewith from a lowered position in frictional engagement with said one or more wire spools, said braking means pivoting on an axis which is offset from and vertically above the axis of said rod, said braking means including one or more elongated wire guides adapted to guide the unwinding of wire from said one or more wire spools, whereby, when wire from said one or more wire spools is unwound from an upwards direction, said braking means engages said wire through said elongate guides, said braking means frictionally engaging said one or more wire spools so as to brake spool rotation when tension on said wire ceases.

2. The wire caddy of claim 1, wherein said rod is adapted for mounting a plurality of wire spools and said braking means permits one or more of said wire spools to be selectively unwound without also unwinding any other of said wire spools.

3. The wire caddy of claim 2, wherein said braking means includes a plurality of elongated wire guides suitably sized for receiving said wire therethrough.

4. The wire caddy of claim 3, wherein said braking means includes an elongate rod located at the base of said handle and pivotally mounted at its ends to said base.

5. The wire caddy of claim 4, wherein said rod is removably mounted to said base.

* * * * *